US009546456B2

(12) United States Patent
Shaw

(10) Patent No.: US 9,546,456 B2
(45) **Date of Patent: *Jan. 17, 2017**

(54) CRUSH ZONE DOWEL TUBE

(71) Applicant: Shaw & Sons, Inc., Costa Mesa, CA (US)

(72) Inventor: Ronald D. Shaw, Costa Mesa, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/098,157

(22) Filed: Apr. 13, 2016

(65) Prior Publication Data

US 2016/0222600 A1 Aug. 4, 2016

Related U.S. Application Data

(63) Continuation of application No. 14/540,288, filed on Nov. 13, 2014, now Pat. No. 9,340,969.

(51) Int. Cl.

| | |
|---|---|
| ***E01C 11/00*** | (2006.01) |
| ***E01C 11/14*** | (2006.01) |
| ***E04B 1/48*** | (2006.01) |
| ***B28B 1/14*** | (2006.01) |
| ***B28B 1/00*** | (2006.01) |
| ***B28B 23/00*** | (2006.01) |
| ***E01C 11/06*** | (2006.01) |

(52) U.S. Cl.

CPC ..... *E01C 11/14* (2013.01); *B28B 1/002* (2013.01); *B28B 1/14* (2013.01); *B28B 23/0056* (2013.01); *E01C 11/06* (2013.01); *E04B 1/483* (2013.01)

(58) Field of Classification Search

CPC ..... E04B 1/483; B28B 1/14

USPC ..... 404/47, 51, 52, 57, 58, 60; 52/396.02, 52/396.03, 396.05, 396.06, 396.08, 573.01

See application file for complete search history.

(56) References Cited

U.S. PATENT DOCUMENTS

| | | | |
|---|---|---|---|
| 754,215 | A | 3/1904 | Hayward |
| 1,045,562 | A | 11/1912 | Kennedy |
| 1,545,267 | A | 7/1925 | Marye |

(Continued)

FOREIGN PATENT DOCUMENTS

| | | |
|---|---|---|
| CH | 568457 | 10/1975 |
| DK | 52370 | 11/1936 |

(Continued)

OTHER PUBLICATIONS

John P. Broomfield, "Corrosion of Steel in Concrete", 1997, 3 pages, E & FN SPON.

(Continued)

*Primary Examiner* — Thomas B Will
*Assistant Examiner* — Katherine Chu
(74) *Attorney, Agent, or Firm* — Stetina Brunda Garred and Brucker

(57) ABSTRACT

A slip dowel tube and elongate dowel are disclosed herein which allow for transverse and longitudinal movement of two adjacent concrete slabs and also limit vertical movement of the two concrete slabs. The slip dowel tube is housed within a sheath that provides a void to allow for transverse movement of the slip dowel tube when the first and second slabs move transversely with respect to each other. The elongate dowel is slidably disposed within the main tube to allow for longitudinal movement or movement which brings the two slabs closer to or further away from each other. This system also limits vertical movement between the two adjacent slabs.

14 Claims, 6 Drawing Sheets

(56) References Cited

U.S. PATENT DOCUMENTS

| | | | |
|---|---|---|---|
| 1,592,681 | A | 7/1926 | Grothe |
| 1,699,557 | A | 1/1929 | Yeager |
| 1,728,936 | A | 9/1929 | Johnson |
| 1,755,219 | A | 4/1930 | Knox |
| 1,767,575 | A | 6/1930 | Bujack |
| 1,826,062 | A | 10/1931 | Farmer |
| 1,838,635 | A | 12/1931 | Pilj |
| 1,852,673 | A | 4/1932 | Pilj |
| 1,939,007 | A | 12/1933 | Heltzel |
| 1,942,494 | A | 1/1934 | Robertson |
| 1,953,846 | A | 4/1934 | Briggs |
| 2,095,060 | A | 10/1937 | Geyer |
| 2,096,702 | A | 10/1937 | Yeoman |
| 2,108,107 | A | 2/1938 | De Wees |
| 2,129,568 | A | 9/1938 | De Biasi |
| 2,166,220 | A | 7/1939 | Older |
| 2,181,005 | A | 11/1939 | Westcott |
| 2,262,704 | A | 11/1941 | Tompkins et al. |
| 2,269,703 | A | 1/1942 | Bagwill |
| 2,275,272 | A | 3/1942 | Scripture, Jr. |
| 2,277,203 | A | 3/1942 | Boult |
| 2,296,453 | A | 9/1942 | Saffert |
| 2,319,526 | A | 5/1943 | Wearn |
| 2,327,231 | A | 8/1943 | Westcott |
| 2,331,949 | A | 10/1943 | Whiteman |
| 2,365,550 | A | 12/1944 | Heltzel |
| 2,373,284 | A | 4/1945 | Autrey |
| 2,508,443 | A | 5/1950 | Carter |
| 2,551,826 | A | 5/1951 | Cox, Sr. |
| 2,636,426 | A | 4/1953 | Heltzel |
| 2,746,365 | A | 5/1956 | Dameille |
| 2,823,539 | A | 2/1958 | Kersh et al. |
| 2,980,215 | A | 4/1961 | Englund |
| 3,066,448 | A | 12/1962 | Pinter |
| 3,124,047 | A | 3/1964 | Graham |
| 3,205,629 | A | 9/1965 | Rumley |
| 3,279,335 | A | 10/1966 | Garner |
| 3,282,613 | A | 11/1966 | Axelsonn |
| 3,284,973 | A | 11/1966 | Ames et al. |
| 3,318,224 | A | 5/1967 | Bohanon |
| 3,333,380 | A | 8/1967 | Wolf |
| 3,437,017 | A | 4/1969 | Walz |
| 3,451,179 | A | 6/1969 | Kendzia |
| 3,527,486 | A | 9/1970 | Gamp |
| 3,603,055 | A | 9/1971 | Dale |
| 1,631,576 | A | 6/1972 | Bowers |
| D229,538 | S | 12/1973 | Steffan |
| 3,896,599 | A | 7/1975 | Werstein et al. |
| 3,920,221 | A | 11/1975 | Berry et al. |
| 3,921,356 | A | 11/1975 | Hughes |
| 4,077,177 | A | 3/1978 | Boothroyd et al. |
| 4,087,072 | A | 5/1978 | Olsen |
| 4,115,976 | A | 9/1978 | Rohrer |
| 4,146,599 | A | 3/1979 | Lanzetta |
| 4,158,937 | A | 6/1979 | Henry |
| D257,503 | S | 11/1980 | McKee |
| 4,252,767 | A | 2/1981 | Piazza et al. |
| 4,261,496 | A | 4/1981 | Mareydt et al. |
| 4,281,496 | A | 8/1981 | Danielsson |
| 4,329,080 | A | 5/1982 | Elley |
| D272,517 | S | 2/1984 | Koehn |
| 4,437,828 | A | 3/1984 | Egger |
| 4,449,844 | A | 5/1984 | Larsen |
| 4,493,584 | A | 1/1985 | Guntert |
| 4,496,504 | A | 1/1985 | Steenson et al. |
| 4,533,112 | A | 8/1985 | Santos, Jr. et al. |
| 4,578,916 | A | 4/1986 | Witschi |
| 4,614,070 | A | 9/1986 | Idland |
| 4,648,739 | A | 3/1987 | Thomsen |
| 4,657,430 | A | 4/1987 | Marionneaux |
| 4,726,561 | A | 2/1988 | Worzala, Jr. |
| 4,748,788 | A | 6/1988 | Shaw et al. |
| 4,752,153 | A | 6/1988 | Miller |
| 4,800,702 | A | 1/1989 | Wheeler |
| 4,801,425 | A | 1/1989 | Michel et al. |
| 4,821,988 | A | 4/1989 | Jimenez |
| 4,883,385 | A | 11/1989 | Kaler |
| 4,899,497 | A | 2/1990 | Madl, Jr. |
| 4,926,593 | A | 5/1990 | Johnston |
| D309,280 | S | 7/1990 | Balfanz-Lee |
| 4,938,631 | A | 7/1990 | Maechtle et al. |
| 4,959,940 | A | 10/1990 | Witschi |
| D314,325 | S | 2/1991 | Ziaylek, Jr. et al. |
| 4,996,816 | A | 3/1991 | Wiebe |
| 5,005,331 | A | 4/1991 | Shaw et al. |
| 5,046,898 | A | 9/1991 | McKinney |
| 5,096,155 | A | 3/1992 | Fitzgerald |
| 5,097,547 | A | 3/1992 | Tanaka |
| 5,134,828 | A | 8/1992 | Bauer |
| 5,205,942 | A | 4/1993 | Fitzgerald |
| 5,212,919 | A | 5/1993 | Shaw et al. |
| 5,216,862 | A | 6/1993 | Shaw et al. |
| 5,301,485 | A | 4/1994 | Shaw et al. |
| D363,211 | S | 10/1995 | Noble |
| 5,487,249 | A | 1/1996 | Shaw et al. |
| D375,599 | S | 11/1996 | Hirano et al. |
| D375,600 | S | 11/1996 | Hirano et al. |
| 5,618,125 | A | 4/1997 | McPhee et al. |
| 5,678,952 | A | 10/1997 | Shaw et al. |
| 5,694,730 | A | 12/1997 | Del Rincon et al. |
| 5,713,174 | A | 2/1998 | Kramer |
| 5,797,231 | A | 8/1998 | Kramer |
| 5,934,821 | A | 8/1999 | Shaw et al. |
| 5,941,045 | A | 8/1999 | Plehanoff |
| D419,700 | S | 1/2000 | Shaw et al. |
| 6,018,833 | A | 2/2000 | Imm |
| 6,039,503 | A | 3/2000 | Cathey |
| 6,123,485 | A | 9/2000 | Mirmiran et al. |
| 6,210,070 | B1 | 4/2001 | Shaw et al. |
| 6,243,994 | B1 | 6/2001 | Bernini |
| 6,354,053 | B1 | 3/2002 | Kerrels |
| 6,354,760 | B1 | 3/2002 | Boxall et al. |
| D459,205 | S | 6/2002 | Shaw et al. |
| 6,502,359 | B1 | 1/2003 | Rambo |
| 6,517,277 | B2 | 2/2003 | Hu et al. |
| 6,655,869 | B1 | 12/2003 | Deeb et al. |
| 6,926,463 | B2 | 8/2005 | Shaw et al. |
| 7,004,443 | B2 | 2/2006 | Bennett |
| 7,314,333 | B2 | 1/2008 | Shaw et al. |
| 7,338,230 | B2 | 3/2008 | Shaw et al. |
| 7,381,008 | B2 | 6/2008 | Shaw et al. |
| 7,604,432 | B2 | 10/2009 | Shaw et al. |
| 7,874,762 | B2 | 1/2011 | Shaw et al. |
| 8,007,199 | B2 | 8/2011 | Shaw et al. |
| 2005/0265802 | A1 | 12/2005 | Miller et al. |
| 2008/0307733 | A1 | 12/2008 | Rice |

FOREIGN PATENT DOCUMENTS

| | | |
|---|---|---|
| EP | 1123443 | 2/2004 |
| EP | 1389648 | 2/2004 |
| FR | 1094449 | 5/1955 |
| WO | WO0023653 | 4/2000 |

OTHER PUBLICATIONS www.pna-inc.com, "The Diamond Dowel System", May 22, 2003, 2 pages.

www.pavement.com, "Load Transfer", May 27, 2003, 2 pages.

www.danley.com.au, "Danley Diamond Dowel System", May 24, 2005, 2 pages.

Wayne W. Walker and Jerry A. Holland, "Plate Dowels for Slabs on Ground", 4 pages.

CRUSH ZONE DOWEL TUBE

CROSS-REFERENCE TO RELATED APPLICATIONS

This is a continuation patent application of U.S. patent application Ser. No. 14/540,288 filed Nov. 13, 2014, the entirety of which is expressly incorporated herein by reference.

STATEMENT RE: FEDERALLY SPONSORED RESEARCH/DEVELOPMENT

Not Applicable

BACKGROUND

The various embodiments and aspects disclosed herein relate to apparatuses and methods for limiting movement between adjacent concrete structures.

In dealing with concrete, cold joints are typically formed between two or more poured concrete slabs. These cold joints may become uneven or buckle due to normal thermal expansion and contraction of the concrete and/or compaction of the underlying flow ground by inadequate substrate preparation prior to pouring of the concrete. In order to mitigate these negative effects, slip dowel systems are typically used to join adjacent concrete slabs that limit vertical movement. However, these systems have various deficiencies.

Accordingly, there is a need in the art for an improved slip dowel system.

BRIEF SUMMARY

The various embodiments and aspects described herein address the deficiencies described above, described below and those that are known in the art.

A slip dowel system is described herein which allows two adjacent concrete slabs to move closer to or further away from each other as well as side to side but limits relative vertical movement therebetween. In particular, the system has a receiving member comprised of an enlarged sheath. The sheath houses a main tube. The enlarged sheath and the main tube are embedded within one of two adjacent slabs. The enlarged sheath allows the main tube to move transversely within the sheath. An elongate dowel is inserted within the main tube and allowed to freely move into and further out of the main tube. A first end portion of the elongate tube is slidably disposed within the main tube. An opposed second end portion of the elongate tube is fixedly embedded within the other slab. When the first and second slabs move away or closer to each other, the first end portion of the elongate dowel slides within the main tube. When the first and second slabs move transversely with respect to each other, the main tube slides within the sheath to permit such transverse movement between the first and second slabs. Crushed tubes may be disposed within the sheath beside the main tube to provide strength to the sheath and for other purposes.

More particularly, a concrete dowel system for limiting vertical movement between adjacent first and second concrete structures and permitting longitudinal and traverse horizontal movement between the adjacent first and second concrete structures is disclosed. The system may comprise a base member, a dowel receiving sheath, left and right crush tubes and an outer sheath. The base member may be attached to a form which forms the first concrete structure. The dowel receiving sheath may have an inner lumen defining a longitudinal axis. The dowel receiving sheath may be attached to the base member so that the longitudinal axis of the inner lumen of the dowel receiving sheath is perpendicular to a vertical edge surface of the form. Left and right crush tubes may be laterally disposed adjacent to left and right sides of the dowel receiving sheath when the base member and the dowel receiving sheath are attached to the vertical edge surface of the form. The outer sheath may cover the dowel receiving sheath and the left and right crush tubes. The outer sheath forms void(s) on the left and right lateral sides of the dowel receiving sheath to allow for transverse horizontal movement with respect to the longitudinal axis between the adjacent first and second concrete structures.

The dowel receiving sheath may be slidably traversable laterally left and right within the outer sheath upon crushing of the left and right crush tubes by a dowel. The left and right crush tubes may have a wall thickness less than a wall thickness of the dowel receiving sheath for allowing the left and right crush tubes to collapse when pressure is applied by the dowel receiving sheath upon lateral movement of the adjacent first and second structures.

The outer sheath, crush tubes and the dowel receiving sheath may be formed as an extruded part.

The inner lumen of the dowel receiving sheath may be circular, square or polygonal.

The outer sheath may have an interior oval cross sectional configuration and the dowel receiving sheath may have an exterior circular cross sectional configuration.

In another aspect, a method of forming adjacent first and second concrete structures that have a limited vertical movement between adjacent first and second concrete structures and permit longitudinal and traverse horizontal movement between the adjacent first and second concrete structures is disclosed. The method may comprise the steps of building a first concrete form; attaching a base member and a dowel receiving sheath to a vertical edge surface of the first concrete form with a longitudinal axis of an inner lumen of the dowel receiving sheath oriented perpendicular to the vertical edge surface of the first concrete form; pouring concrete into the first concrete form and allowing the concrete to set which defines the first concrete structure; forming voids on left and right lateral sides of the dowel receiving sheath to allow for transverse horizontal movement with respect to the longitudinal axis between the adjacent first and second concrete structures; removing the first concrete form and the base member from the first concrete structure; sliding a dowel into the inner lumen of the dowel receiving sheath; building a second concrete form adjacent to the first concrete structure; and pouring concrete into the second concrete form and allowing the concrete to set which defines the second concrete structure.

In the method, the attaching step may include the step of disposing the base member and the dowel receiving sheath on opposed sides of the first concrete form. The attaching step may further include the step of forming a hole within the first concrete form, inserting a distal portion of the base member through the hole of the first concrete form and securing the dowel receiving sheath to the distal portion of the base member.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
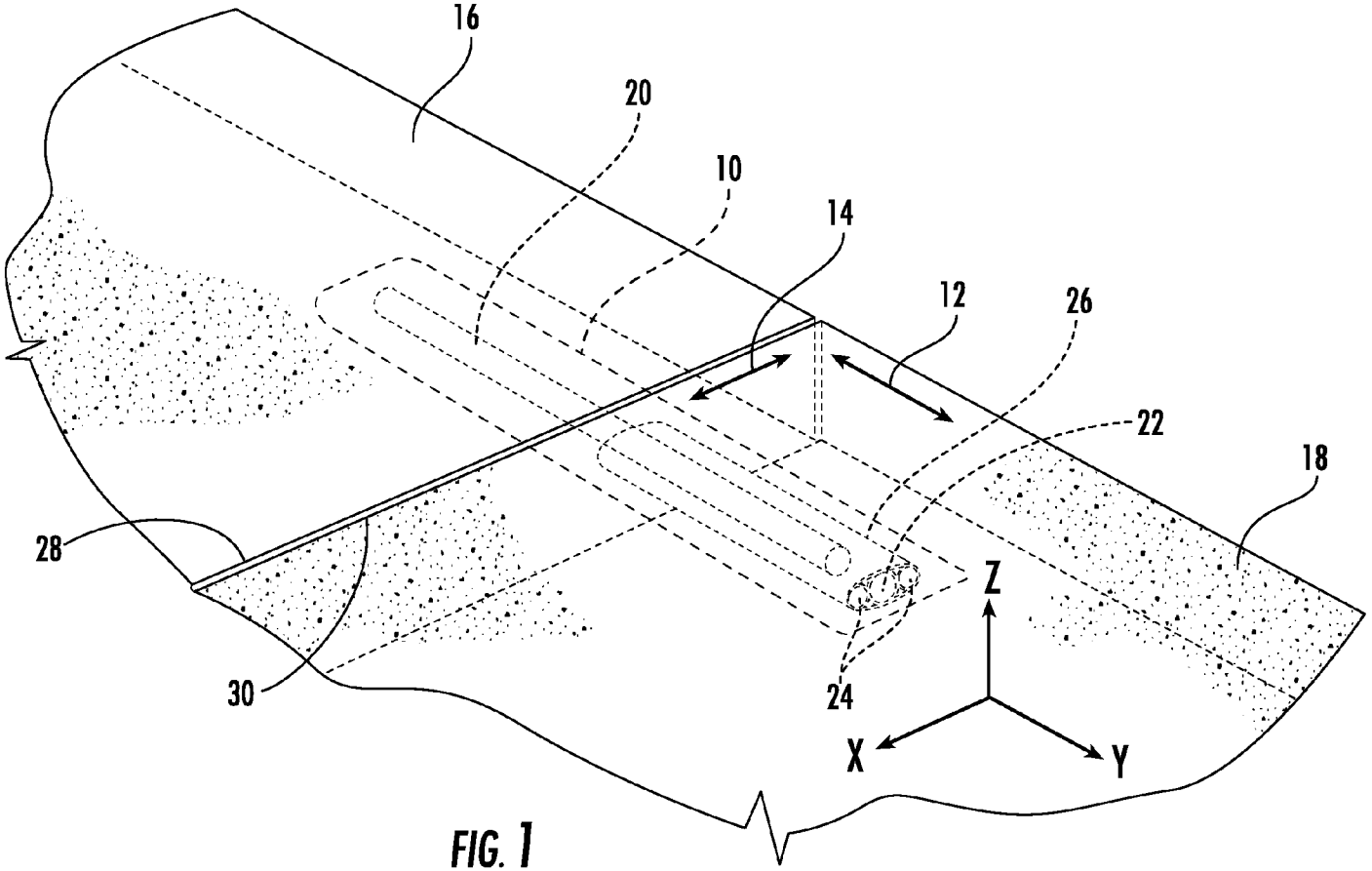
FIG. 1 is a perspective view of first and second slabs that are transversely and longitudinally movable with respect to each other but limited in a vertical direction.

Referring now to the drawings, a slip dowel system 10 that provides for longitudinal movement 12 and transverse movement 14 between two adjacent concrete slabs 16, 18 is shown. The slip dowel system 10 has a dowel 20 that is embedded in the first slab 16 and slidably embedded within the second slab 18. In particular, the dowel 20 extends out of the first slab 16 and into a main tube 22 embedded within the second slab 18. The first and second slabs 16 and 18 can move in the longitudinal direction 12 since the dowel 20 slides in and out of the main tube 22. Lateral crush tubes 24 are disposed adjacent to the main tube 22 to centrally locate the main tube 22 within a sheath 26. When the first and second slabs 16, 18 move transversely 14 with respect to each other, the main tube 22 crushes the crush tubes 24 to make room for the main tube 22 within the sheath 26 and also to allow for transverse movement between the two slabs 16, 18. In this manner, the first and second slabs 16, 18 are able to move longitudinally 12 and transversely 14 with respect to each other. However, the edges 28, 30 of the first and second slabs 16, 18 are limited in its vertical movement in the Z direction.

Figure 2:
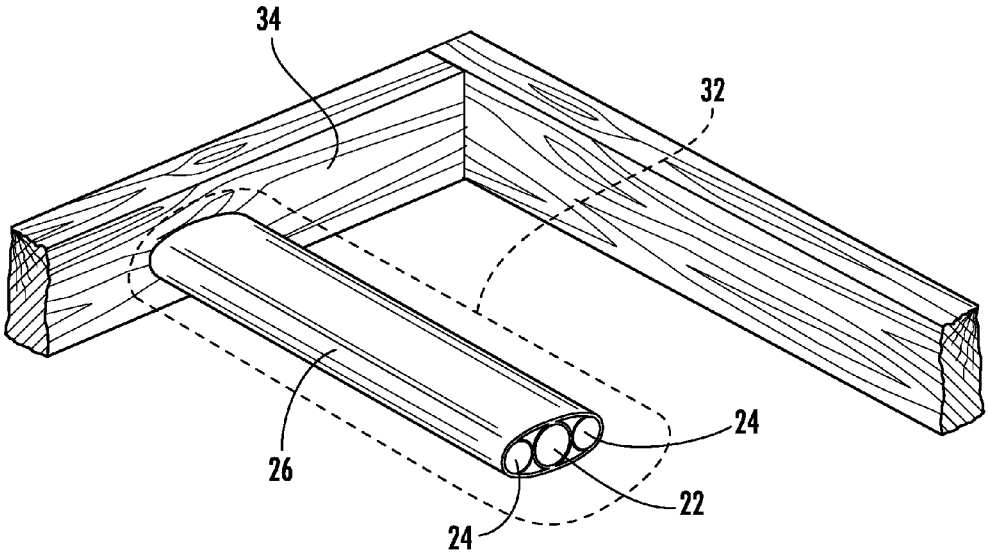
FIG. 2 is a perspective view of a concrete form with a receiving member mounted to the concrete form.
Figure 3:
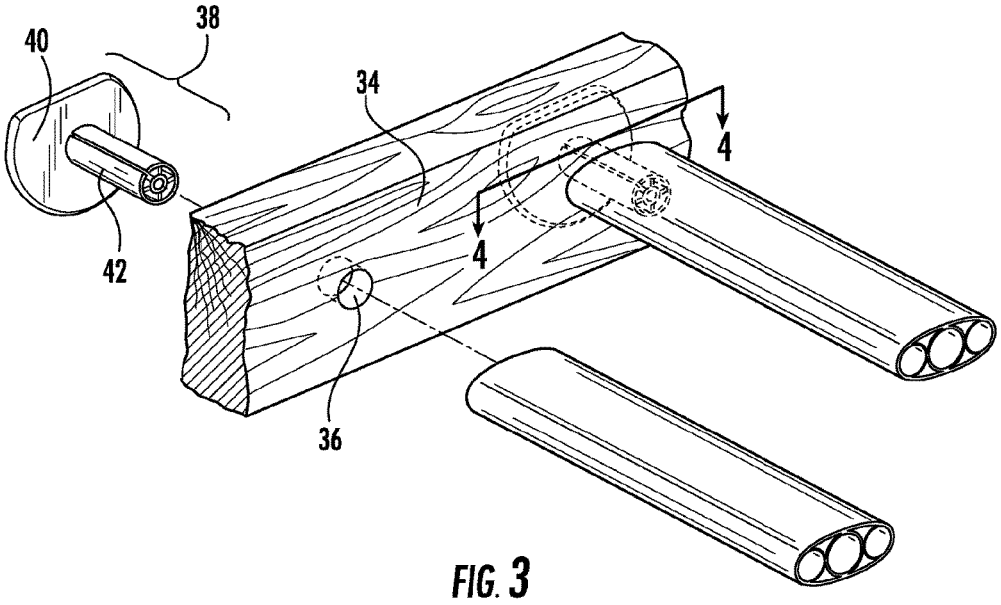
FIG. 3 is a perspective view of the concrete form and receiving member illustrating mounting of the receiving member to the concrete form with a base plate.

Referring now to FIGS. 2 and 3, the receiving member 32 which includes the sheath 26, main tube 22 and the lateral crush tubes 24 may be mounted to a concrete form 34. The concrete form 34 may be fabricated from wood and may be laid down on the ground to form a cavity in which uncured concrete 44 is poured into so that the uncured concrete 44 can take the form of the concrete form 34. To position the receiving member 32 in the concrete slab 16, 18, the receiving member 32 is mounted to a side of the concrete form 34, as shown in FIG. 3. In particular, the concrete form 34 is modified with a through hole 36. Preferably, the through hole 36 is circular and formed with a drill and is perpendicular to the inner side surface of the concrete form 34.

Figure 4:
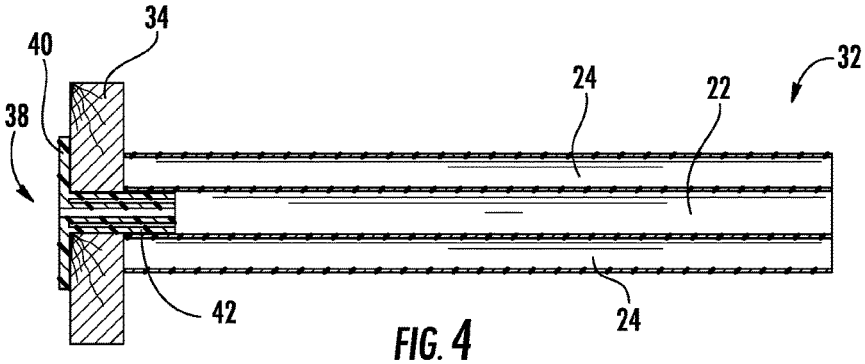
FIG. 4 is a top view of the base plate, concrete form and receiving member shown in FIG. 3.
Figure 5:
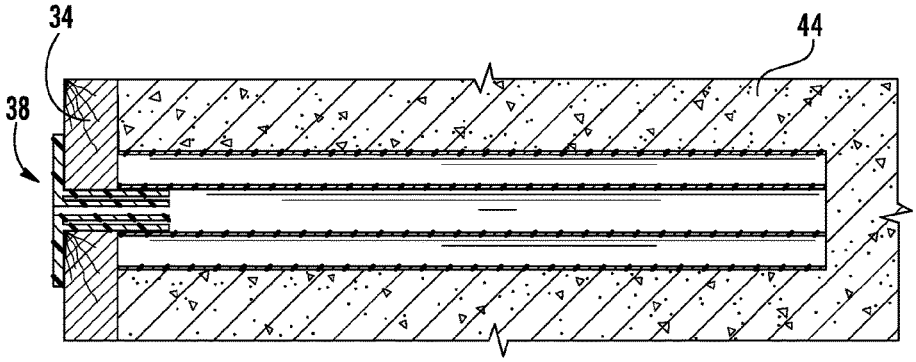
FIG. 5 is a top view of the base plate, concrete form and receiving member after concrete is poured into the concrete form.

A base plate 38 may be used to hold the receiving member 32 in position as the uncured concrete 44 is being poured into the form 34. The base plate 38 has a base member 40 and a distal portion 42. The distal portion 42 is inserted through the through hole 36 and extends out into the interior of the concrete form 34, as shown in FIG. 4. The distal portion 42 may have a friction fit with the through hole 36 in order to retain the base plate 38 in position while pushing the receiving member 32 onto the distal portion 42 of the base plate 38. The base member 40 limits the insertion depth of the distal portion 42 of the base plate 38 into the through hole 36. When the base plate 38 is fully inserted into the through hole 36, the distal portion 42 extends into the interior of the concrete form 34 as shown in FIGS. 4 and 5. Also, the base member 40 contacts the form 34. With the base plate 38 mounted to the concrete form 34, the user holds the backside of the base plate 38 while inserting the distal portion 42 of the base plate 38 into the main tube 22 of the receiving member 32. The receiving member 32 may be held in position to the concrete form 34 with the base plate 38 or as described in U.S. patent application Ser. Nos. 13/728,947 or 14/156,098, the entire contents of which are expressly incorporated herein by reference.

Figure 6:
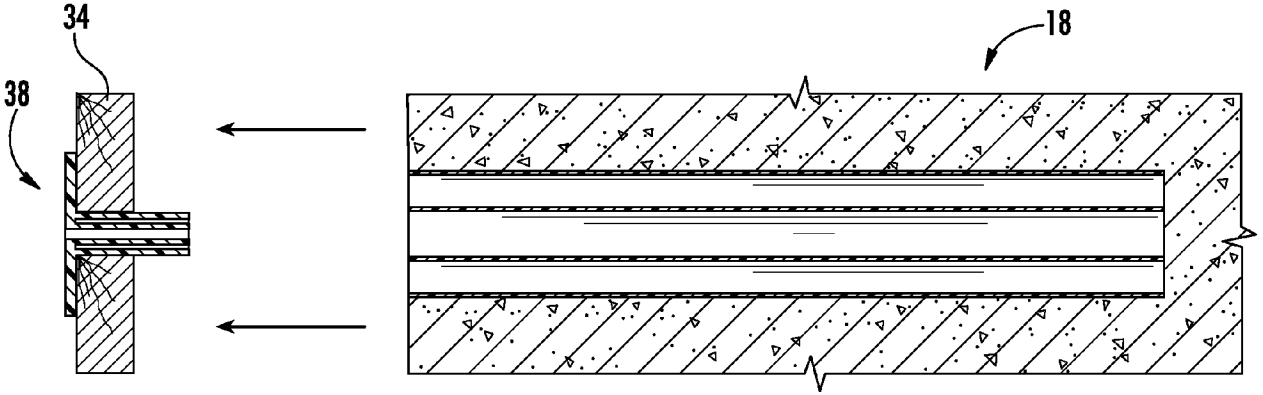
FIG. 6 is a top view of the base plate and concrete form removed from a cured concrete showing the receiving member embedded within the slab.
Figure 7:
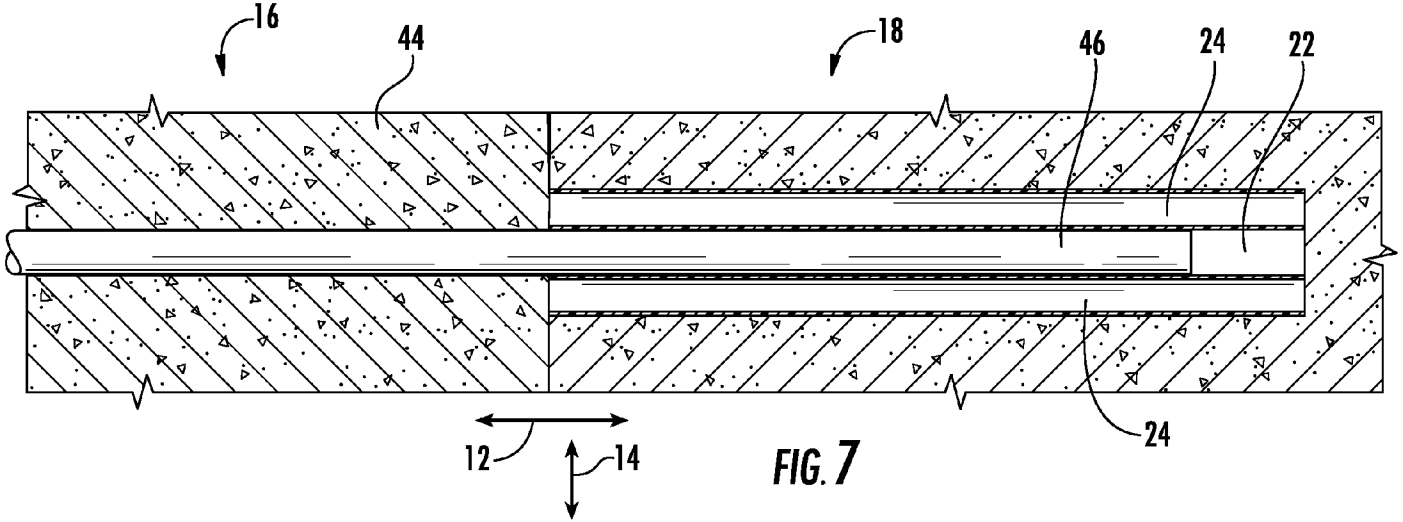
FIG. 7 illustrates an elongate dowel slidably disposed within the main tube of the receiving member embedded within one of two slabs and the elongate dowel embedded within the other one of the two slabs for providing longitudinal and transverse movement between the two slabs but limiting movement in the vertical direction.

After the receiving member 32 is mounted to the base plate 38, uncured concrete 44 may be poured into the concrete form 34 and allowed to cure over time, as shown in FIG. 5. After the concrete 44 is cured, the base plate 38 is removed from the main tube 22 of the receiving member 32 when the concrete form 34 is removed from the concrete slab 18, as shown in FIG. 6. An elongate dowel 46 is inserted into the main tube 22 of the receiving member 32. Preferably, one half of the elongate dowel 36 is inserted into the main tube 22 of the receiving member 32 while one half of the elongate dowel 36 extends outward and eventually is embedded within the first slab 16. With one half of the elongate dowel 36 extending out of the slab 18, a concrete form 34 is formed adjacent to the slab 18 to form the slab 16. The edge of the slab 18 forms one side of the concrete form 34. Concrete 44 is poured to form the slab 16 and directly contacts the protruding portion of the elongate dowel 46. The slabs 16, 18 are two separate slabs 16, 18 that can move with respect to each other except that it is restrained in the vertical direction. The dowel 46 retracts out of the main tube 22 and back into the main tube 22 to provide for relative longitudinal motion between the first and second slabs 16, 18 (see FIG. 7). As will be discussed further below, the first and second slabs 16, 18 can move transversely with respect to each other by allowing the main tube 22 to crush the lateral crush tubes 24. This is shown by arrow 14 in FIG. 7. Vertical movement is limited.

Figure 8:
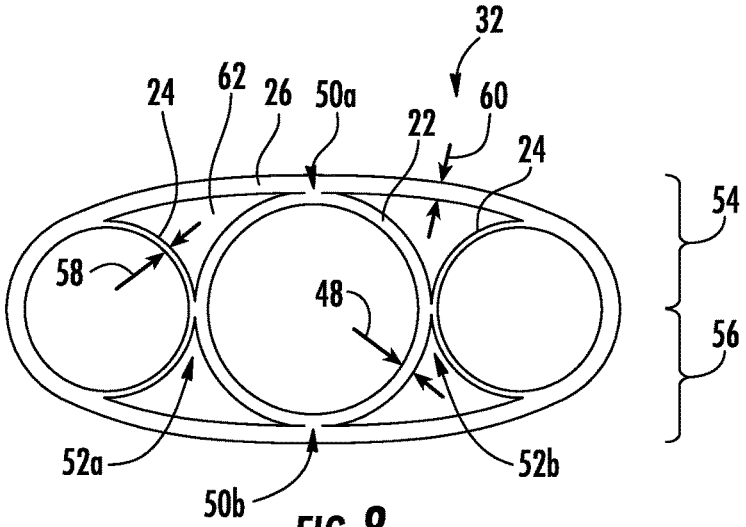
FIG. 8 is an end view of the receiving member with the main tube and two side crush tubes.

Referring now to FIG. 8, the receiving member 32 includes the main tube 22, lateral crush tube 24 and sheath 26. The main tube 22, lateral crush tubes 24 and the sheath 26 may be extruded from an aluminum material. Other materials are also contemplated such as polymeric materials, plastics, metallic and non-metallic materials. Preferably, the main tube 22 may have a thickness 48 sufficient to withstand the weight of the concrete 44 surrounding the receiving member 32 as well as any downward forces caused by pedestrian or vehicular traffic over the slab 18. In this manner, the elongate dowel 46 can slide into and out of the lumen of the main tube 22 regardless of such forces. The main tube 22 may be secured to the sheath 26 at one or two places. In FIG. 8, the main tube 22 is connected to the sheath 26 at opposed sides 50*a*, b. The main tube 22 may also be connected to the lateral crush tubes 24 at opposed sides 52*a*, b. The main tube 22 may be secured to the sheath 26 and the lateral crush tubes 24 by joining the walls of the main tube 22 to the sheath 26 and the main tube 22 to the lateral crush tubes 24 in the extrusion process. A sliver of material may be used to connect the main tube 22 to the sheath 26 so that upon transverse movement of the first and second slabs 16, 18, the sliver of material at 50*a, b* may rupture (see FIGS. 9A and 9B) allowing the main tube 22 to move in the transverse direction within the sheath 26. The movement of the main tube 22 crushes the lateral tubes 24. Alternatively, the main tube 22 may be detached from the sheath 26 at opposed sides 50*a, b* when formed in the extrusion process. In particular, a gap may exist between the main tube 22 and the sheath 26 at opposed sides 50*a, b*. The attachment of the main tube 22 to the lateral crush tubes 24 holds the main tube 22 in place during the extrusion process. As a further alternative, the main tube 22 may be secured to only one of the two lateral crush tubes 24.

Figure 9A:
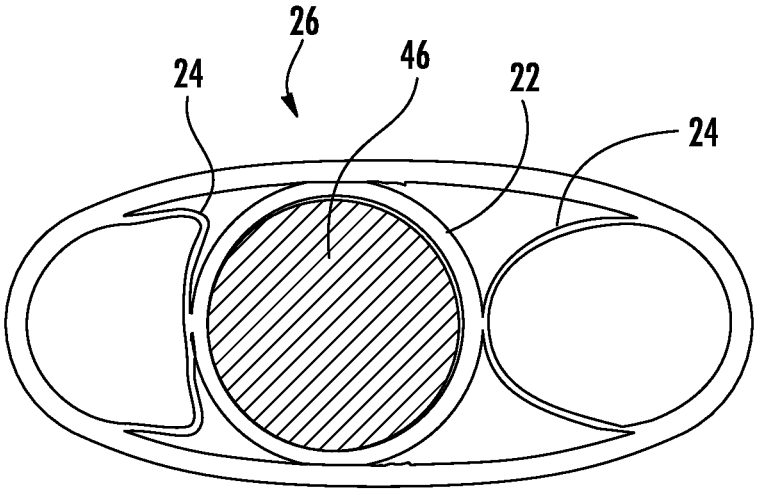
FIG. 9A illustrates one of the crush tubes being crushed as the main tube moves in a left direction.

The lateral crush tubes 24 may have a thickness 58 sufficient to hold the main tube 22 in place but also be capable of being deformed as shown in FIGS. 9A, B to allow the first and second slabs 16, 18 to move transversely with respect to each other. The sheath 26 may have an oval configuration as shown in FIG. 8 with upper and lower halves forming curved walls 54, 56. The upper and lower curved walls 54, 56 may have a curved configuration in order to support the weight of the concrete 44 and prevent crushing of the tubes 22, 24 under the weight of the concrete, vehicular traffic and pedestrian traffic.

The sheath 26 may have a thickness 60 which is sufficient to withstand the weight of the concrete 44 so that a void 62 is maintained within the sheath 26 to allow for transverse movement of the main tube 22 within the sheath 26.

Figure 8A:
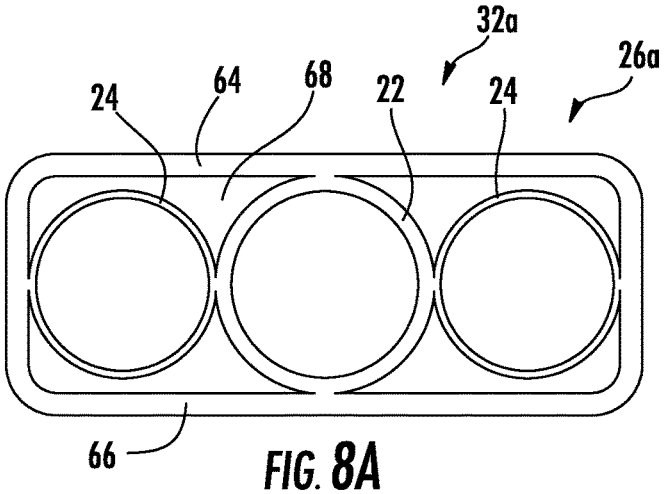
FIG. 8A is a variant of the main tube, sheath and side crush tube shown in FIG. 8.

FIG. 8A is an alternate embodiment of the receiving member 32*a* and is identical to the receiving member 32 described in relation to FIG. 8 except for the following characteristics. The upper and lower walls 64, 66 of the sheath 26*a* may have a flat configuration which is parallel to each other. As the main tube 22 is transverse laterally due to transverse movement 14 of the first and second slabs 16, 18, the void 68 of the sheath 26*a* is substantially larger compared to the void 62 (see FIG. 8) to allow for freer transverse movement of the main tube 22 within the sheath 26*a*. The main tube 22 may be attached to the sheath 26*a* and the lateral tubes 24 at four places as shown in FIG. 8A with a minute amount of material therebetween created during the extrusion process. It is also contemplated that the main tube 22 may be attached to both or only one of the lateral crush tubes 24.

The crush tubes 24 of the receiving member 32*a* shown in FIG. 8A compared to the crush tubes 24 of the receiving member 32 are more prone to deformation. The reason is that the sheath 26*a* which is embedded within the concrete does not provide as much support to the wall of the lateral crush tube 24 in relation to the receiving member 32*a* as compared to the receiving member 32 shown in FIG. 8.

Figure 8B:
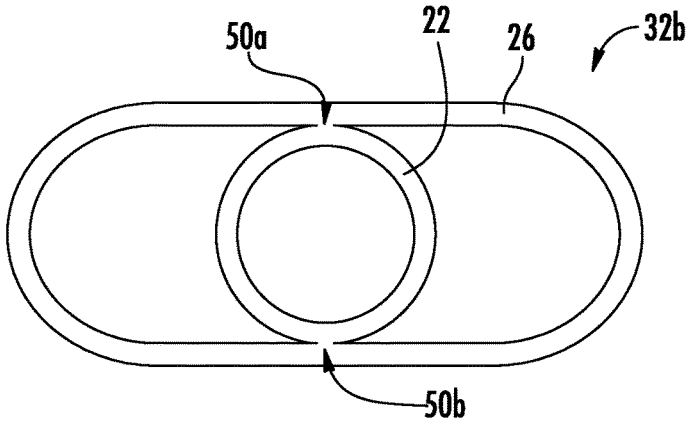
FIG. 8B is another variant of the receiving member shown in FIGS. 8 and 8A.

Referring further still to FIG. 8B, a further embodiment of the receiving member 32*b* is shown. The receiving member 32*b* may be identical to the receiving member 32 in relation to FIG. 8 except for the following characteristics. In particular, the main tube 22 may be connected to the sheath 26 at the opposed sides 58*a*, b. Alternatively, the main tube 22 may be connected at one of the two places 50*a, b*. The receiving member 32*b* has no crush tubes 24 on lateral sides of the main tube 22. The main tube 22 is held in place during pouring of the concrete 44 by the attachment 50*a* and/or 50*b*.

Figure 9B:
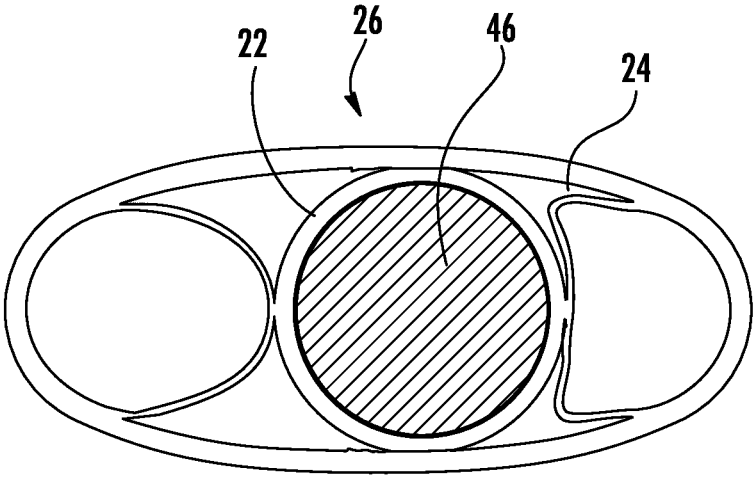
FIG. 9B illustrates the other one of the crushed tubes being crushed as the main tube moves in a right direction.

Referring now to FIGS. 9A, 9B, when the first and second slabs 16, 18 move transversely with respect to each other, the elongate dowel 46 moves to the left as shown in FIG. 9A or to the right is shown in FIG. 9B. In doing so, the main tube 22 pushes upon the crush tubes 24 and deforms the crush tubes 24. Also, any connection between the tube 22 and the sheath 26 is ruptured.

The slip dowel system was discussed in relation to two concrete slabs. However, the slip dowel system may be used or incorporated into other adjacent structures that require lateral and horizontal movement but not vertical movement. Other structures include and are not limited to concrete walls, wooden structures and other structures made from other materials.

The above description is given by way of example, and not limitation. Given the above disclosure, one skilled in the art could devise variations that are within the scope and spirit of the invention disclosed herein, including various ways of arranging the sheath crush tube and main tube. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A dowel system for limiting vertical movement between adjacent first and second structures and permitting longitudinal and transverse horizontal movement between the adjacent first and second structures, the system comprising:

a base member attachable to a form having a substantially planar first surface which is used to form a substantially planar surface of the first structure;

a dowel receiving member having a longitudinal axis, wherein the dowel receiving member is removably mountable on the base member so that the longitudinal axis of the dowel receiving member is perpendicular to the first surface of the form; and first and second crush tubes disposed adjacent to opposing lateral sides of the dowel receiving member when the dowel receiving member is mounted on the base member which is attached to the form.

2. The system of claim 1, wherein the dowel receiving member has an inner surface defining a closed channel along the longitudinal axis of the dowel receiving member.

3. The system of claim 2, wherein a shape of the closed channel of the dowel receiving member is circular, square or polygonal.

4. The system of claim 1, further comprising an outer sheath covering the dowel receiving member and the first and second crush tubes.

5. The system of claim 4, wherein the outer sheath forms voids on the opposing lateral sides of the dowel receiving member to allow for transverse horizontal movement with respect to a longitudinal axis of the adjacent first and second structures.

6. The system of claim 4, wherein the outer sheath has an interior oval cross sectional configuration and the dowel receiving member has an exterior circular cross sectional configuration.

7. The system of claim 4, wherein the dowel receiving member is slidably traversable laterally within the outer sheath upon crushing of the first and second crush tubes by a dowel.

8. The system of claim 1, wherein the first and second crush tubes have a wall thickness less than a wall thickness of the dowel receiving member for allowing the first and second crush tubes to collapse when pressure is applied by the dowel receiving member upon transverse horizontal movement of the adjacent first and second structures.

9. The system of claim 1, wherein the outer sheath, first and second crush tubes and the dowel receiving member are formed as an extruded part.

10. A dowel system for limiting vertical movement between adjacent first and second structures and permitting longitudinal and transverse horizontal movement between the adjacent first and second structures, the system comprising:

a base member attachable to a form having a substantially planar first surface which is used to form a substantially planar surface of the first structure;

a dowel receiving member having an inner surface defining a closed channel extending along a longitudinal axis of the dowel receiving member, wherein the dowel receiving member is removably mountable on the base member so that the longitudinal axis of the dowel receiving member is perpendicular to the first surface of the form; and an outer sheath covering the dowel receiving member, wherein the outer sheath has an interior oblong cross-sectional configuration and the dowel receiving member has an exterior circular cross-sectional configuration, and wherein the dowel receiving member is attached to the outer sheath at an upper side and a lower side of the dowel receiving member.

11. The system of claim 10, wherein the dowel receiving member is slidably traversable laterally within the outer sheath.

12. The system of claim 10, further comprising first and second crush tubes disposed adjacent to opposing lateral sides of the dowel receiving member, wherein the outer sheath covers the dowel receiving member and the first and second crush tubes.

13. The system of claim 12, wherein the outer sheath forms voids on the opposing lateral sides of the dowel receiving member to allow for transverse horizontal movement with respect to a longitudinal axis of the adjacent first and second structures.

14. The system of claim 12, wherein the first and second crush tubes have a wall thickness less than a wall thickness of the dowel receiving member for allowing the first and second crush tubes to collapse when pressure is applied by the dowel receiving member upon transverse horizontal movement of the adjacent first and second structures.

* * * * *